US012569901B2

(12) United States Patent
Burtscher

(10) Patent No.: US 12,569,901 B2
(45) Date of Patent: Mar. 10, 2026

(54) DEVICE AND METHOD FOR PROVIDING A SUGGESTION FOR THE OPTIMAL ADJUSTMENT OF A SHEET METAL WORKING MACHINE

(71) Applicant: ARKU MASCHINENBAU GMBH, Baden-Baden (DE)

(72) Inventor: Jacques Burtscher, Roeschwoog (FR)

(73) Assignee: ARKU MASCHINEBAU GMBH, Baden (DE)

( * ) Notice: Subject to any disclaimer, the term of this patent is extended or adjusted under 35 U.S.C. 154(b) by 583 days.

(21) Appl. No.: 17/960,575

(22) Filed: Oct. 5, 2022

(65) Prior Publication Data

US 2023/0108679 A1 Apr. 6, 2023

(30) Foreign Application Priority Data

Oct. 6, 2021 (DE) ..... 10 2021 125 911.8
Mar. 25, 2022 (EP) ..... 22164497

(51) Int. Cl.
*B21C 51/00* (2006.01)

(52) U.S. Cl.
CPC ..... *B21C 51/00* (2013.01)

(58) Field of Classification Search
CPC ..... B21C 51/00; G05B 2219/45234; G05B 19/401; B24B 21/008; B24B 49/183; B24B 51/00; B24B 27/0023
See application file for complete search history.

(56) References Cited

U.S. PATENT DOCUMENTS

2005/0010325 A1* 1/2005 Dai ..... G05B 19/4093 700/173
2019/0030582 A1* 1/2019 Olsson ..... B23K 26/38
(Continued)

FOREIGN PATENT DOCUMENTS

DE 199 15 909 A1 6/2000
DE 10 2019 107 694 A1 10/2020
(Continued)

OTHER PUBLICATIONS

Jacques Burtscher, "Machine for processing sheet metal parts" (ip.com English machine translation of DE202020107308), Dec. 16, 2020, ip.com machine translation (Year: 2020).*
(Continued)

*Primary Examiner* — Christopher W Carter
(74) *Attorney, Agent, or Firm* — Oliff PLC

(57) ABSTRACT

A machine for machining sheet metal parts has a plurality of machining stations along a continuous conveyor belt, including a first sanding belt unit with an endlessly rotating sanding belt, a brush unit with horizontally rotating abrasive brushes and a second sanding belt unit with a fine-grained sanding belt. The three machining stations can be adjusted independently, and the machining tools are interchangeable. The technical data of the machining tools is stored in a tool memory. The machine includes a device for providing a suggestion for an optimal adjustment as well as an operator terminal with a touch screen, via which the user can make inputs and/or receive information from or about the machine. Based on the data entered by the user and the data stored in the machine, the user receives a suggestion for the optimal adjustment of the machine and is prompted to change the tool if necessary.

13 Claims, 4 Drawing Sheets

(56) References Cited

U.S. PATENT DOCUMENTS

| | | | | |
|---|---|---|---|---|
| 2019/0086904 | A1* | 3/2019 | Fischer | G05B 19/41865 |
| 2019/0151924 | A1* | 5/2019 | Nillies | B21D 31/005 |
| 2020/0306908 | A1 | 10/2020 | Ozeki | |
| 2021/0078126 | A1* | 3/2021 | Steinkopf | B23Q 15/22 |
| 2022/0184775 | A1 | 6/2022 | Bettermann | |

FOREIGN PATENT DOCUMENTS

| | | | |
|---|---|---|---|
| DE | 10 2020 201 751 | A1 | 10/2020 |
| DE | 20 2020 107 308 | U1 | 2/2021 |

OTHER PUBLICATIONS

Sep. 19, 2022 Search Report issued in European Patent Application No. 22164497.4.

* cited by examiner

DEVICE AND METHOD FOR PROVIDING A SUGGESTION FOR THE OPTIMAL ADJUSTMENT OF A SHEET METAL WORKING MACHINE

The present invention relates to a device for providing a suggestion for the optimal adjustment of a sheet metal working machine having a plurality of machining stations with machining tools arranged along a conveyor belt. The invention further relates to a method for providing a suggestion for the optimal adjustment of such a sheet metal working machine and further to a correspondingly designed machine.

When cutting and punching parts from sheet steel, annoying burrs form on the cut edges and the edges of holes and recesses which protrude on the top or bottom side. Particularly in the case of parts made of sheet steel several centimeters thick, greater technical effort is required to deburr them, round the edges and grind the surface flat.

DE 20 2020 107 308 U1 describes a sheet metal working machine with three machining stations which are arranged one behind the other along a continuous conveyor belt in the process flow direction of the workpiece. Each machining station is equipped with a different machining tool.

The first machining station is a first sanding belt unit with a coarse-grained sanding belt that circulates endlessly and is driven by an electric motor. This machining station is used for deburring. Protruding burrs are ground off by the coarse-grained grinding belt. For this purpose, the machining gap or the infeed, i.e., the distance between the grinding belt and the working strand of the conveyor belt, must be adjusted. Furthermore, the speed of the grinding belt must be adapted to the workpiece.

The second machining station is a brush unit with a total of eight abrasive brushes, four of which rotate about horizontal axes in the direction of travel and four in the opposite direction. At the same time, the abrasive brushes can rotate together about a vertical axis. This results in a multi-rotational movement of the abrasive brushes. The abrasive brushes consist of a large number of flexible abrasive lamellae that sweep over the surface of the sheet metal part and can also penetrate recesses to some extent. This way, the surface of the sheet metal part is smoothened, and at the same time both the lateral and the internal edges are rounded. By means of a height adjustment device arranged between the drive unit and the machine frame, the machining gap or the infeed can be adjusted very precisely. The rotation speed of the abrasive brushes as well as the rotation speed about the vertical axis can be adjusted as well.

The third and final machining unit is a second sanding belt unit which is arranged behind the central brush unit. Unlike the first sanding belt unit, the second sanding belt unit has a fine-grained sanding belt or a sanding fleece which is endless once again and circulates between a contact roller and a deflection roller. Both sanding belt units are driven by their own electric motor. The second sanding belt unit with the fine-grained sanding belt is used for fine sanding the upper side of the sheet metal part. The machining gap or the infeed can be set very precisely independent of the other machining stations. The result is a cleanly deburred workpiece with rounded edges and a finely sanded surface.

The conveying speed of the conveyor belt, with which the sheet metal part to be machined is moved underneath the machining tools of the machining stations, can also be adjusted and adapted to the respective machining situation.

The machining stations can be equipped with different machining tools, for which the machine preferably has a quick-change tool device. Sanding belts of different materials and grits can, for example, be inserted into the sanding belt units, and different abrasive brushes can be inserted into the brush unit, for example, those with bristles made of steel or abrasive drums with a plurality of flexible abrasive lamellae.

The right choice of tools can improve the results for different applications. The suitability of these tools varies depending on the different types of material, sheet thicknesses or contours of the sheet metal part to be machined. This considerably expands the range of applications for the machine.

The machining result at the edge of the sheet metal part is often a compromise between the part throughput or machining time and the material removed at the sheet metal edge. If, for example, the throughput speed is increased during the rounding process, the edge radius is reduced. If, on the other hand, the radius at the edge is to be increased, the processing speed must be reduced with the result that the machine processes fewer parts during the same time.

The interaction between the machine and the machining tools must therefore be well coordinated. An optimal combination of tool selection, adjustment values for the machining gap, rotation speeds of the sanding tools and the speed of the conveyor belt requires a great deal of experience and knowledge. Certain combinations, for example, a high transport speed with too small of a machining gap, can also quickly lead to major damage to the machine and the loss of workpieces.

The object of the invention is to assist an operator with little experience with the adjustment of the machine and/or selection of the tools by providing a suggestion for the optimal adjustment.

The object is achieved by a device according to the first claim.

The device according to the invention comprises two input interfaces, wherein the first input interface is used for receiving data relating to the workpiece and the second input interface is used for receiving information about the machine or the machining stations and, if applicable, the machining tools used or usable in the machining stations. Based on the information entered or available, a suggestion for the optimal adjustment of the machine is then determined and transmitted either to the operator or optionally also directly to the control unit of the machine.

The operator can make adjustments by means of a screen, in particular a touch-sensitive screen. In a first input window, for example, the user is prompted to enter the data of the workpiece, in particular information about the material thickness, external shape, size, weight, surface finish and/or formation of the edges. A choice can be made, for example, between the materials aluminum, steel or stainless steel and between a small, medium or large strength of the burrs.

In the following second input window, the operator can enter the desired result of the machining. For example, the rounding radius of the edges can be selected from four size levels or whether the surface should only be coarsely sanded, finely sanded or satin finished.

From the information entered by the user and the machine data, the device according to the invention forms a key which represents the machining case. This key is compared to stored keys from previous or predetermined machining cases. If the created key matches one of the stored keys, either that key is selected or, if more than one key matches, the key that promises the best result is selected. If no matching key is found, this can lead to the output of an error message, whereupon the operator can make new, modified entries. If necessary, the adjustment suggestion can also include a suggestion for a tool change if the desired result cannot be achieved with the existing configuration, in particular the active machining tools in the machining stations, or only with very poor results.

Each machining tool that can be inserted into one of the machining stations may be stored in a tool or abrasive medium memory. For this purpose, the different machining tools may be coded. Each machining tool may be associated with certain adjustment values for the adjustment of the machine, for example, information about the allowed and/or optimal rotational speed, the appropriate infeed and/or the transport speed at which the sheet metal part is moved past the respective machining tool.

If the adjustment suggestion determined by the evaluation unit is accepted, either automatically by the logic or after a manual confirmation by the user, the data record can be transferred directly to the machine control unit in order to automatically make the adjustments of the machining tools and/or the transport speed of the conveyor belt.

The object is also achieved by a machine according to claim 7, which comprises a device for providing a suggestion for the optimal adjustment as explained above. The machine according to the invention combines the user's input about the workpiece as well as the desired result with the known data and parameters of the available machining tools and automatically adjusts the entire machine to the machining case by linking this information in such a way that the result is achieved at the highest possible machining speed and the best possible quality. This means that the machine operator no longer has to try things out, incorrect adjustments are avoided, and empirical values are subsequently stored in the machine so that they can be referred to when a comparable machining case occurs again.

In a particularly preferred embodiment, the machine according to the invention also has an automatic wear measurement system for at least one of the machining tools, for example, the brush unit. The result of this wear measurement can then be automatically taken into account and compensated for by the control unit, thus sparing the operator the need to make remeasurement and conversion calculations.

Another aspect of the invention relates to a computer program product comprising program code for carrying out the method according to the invention for providing a suggestion for an optimal adjustment of a sheet metal working machine when the program code is executed on a computer. Likewise to be protected is a storage medium on which a computer program is stored which, when run on a computer, causes the method described to be carried out.

Below, one embodiment of the invention will be explained with reference to the accompanying figures.

Figure 1:
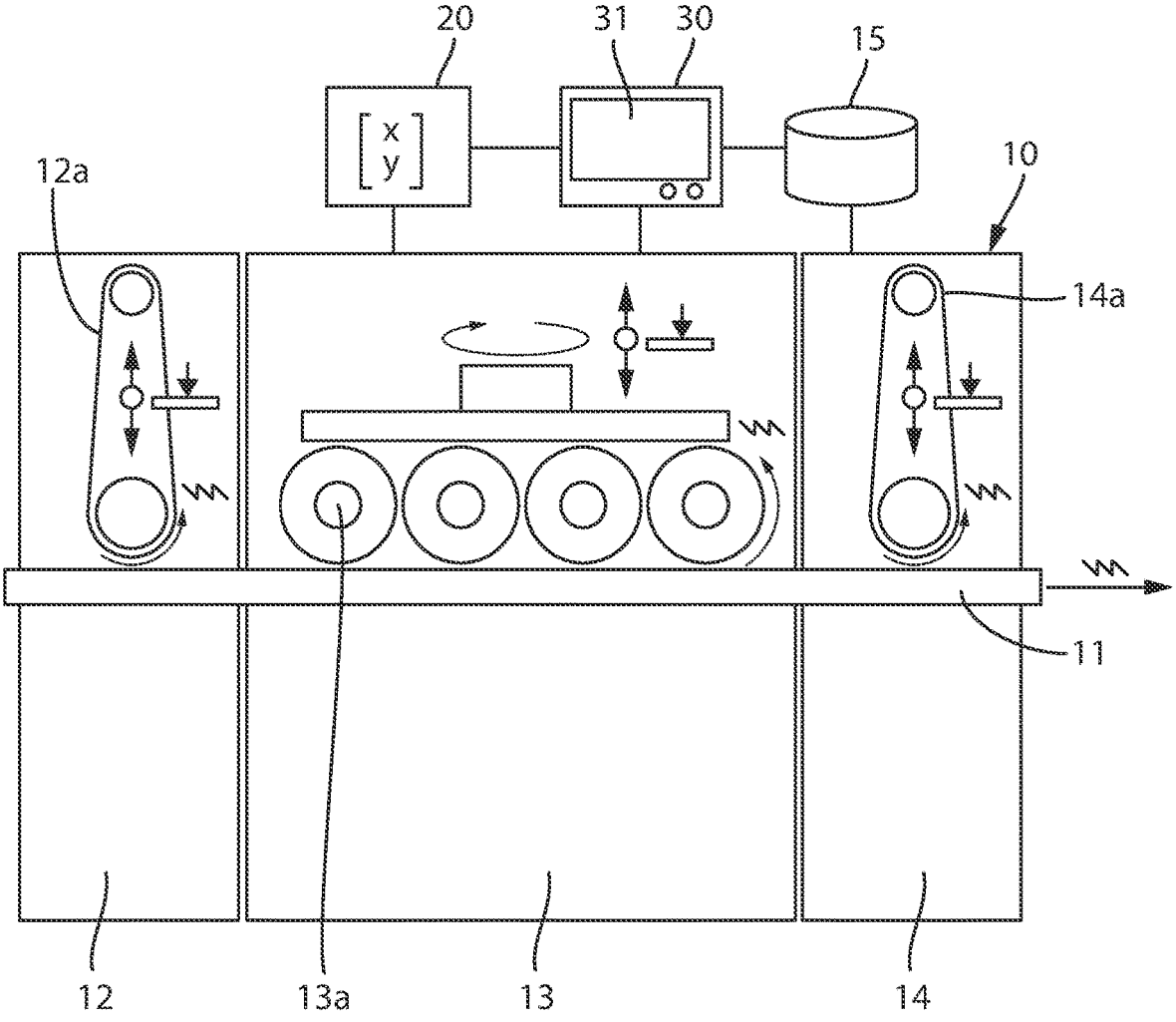
FIG. 1 is a diagram of a machine for machining sheet metal parts.

The machine 10 shown in the diagram of FIG. 1 is used for machining relatively thick sheet metal parts made of steel or stainless steel. The machine has three machining stations which are arranged one after the other along a continuous conveyor belt 11 in the process flow direction of the workpiece.

The first machining station is a first sanding belt unit 12 with a coarse-grained sanding belt 12*a* which rotates endlessly and is driven by an electric motor. The second machining station is a brush unit 13 having a total of eight abrasive brushes 13*a*, four of which rotate about their horizontal axes in the direction of travel and four of which rotate about their horizontal axes in the opposite direction. At the same time, the abrasive brushes 13*a* can rotate together about a vertical axis. This results in a multirotational movement of the abrasive brushes 13*a*. The third and final machining unit is a second sanding belt unit 14 which is arranged behind the brush unit 13. In terms of its design, it corresponds largely to the first sanding belt unit 12 but has a considerably finer-grained sanding belt 13*a* which is used for fine sanding the upper side of the sheet metal part.

The sheet metal part to be machined is placed on the conveyor belt 11 and passes through the machine 10 from left to right. First, the sheet metal part is deburred by means of the first sanding belt unit 12. Then, by means of the brush unit 13, the edges are rounded and the surface is brushed. Finally, the surface is finely sanded by means of the sanding belt unit 14 and thus receives a finish.

The three machining stations, i.e., the first sanding belt unit 12, the brush unit 13 and the second sanding belt unit 14, can be adjusted independently of each other. Both the processing speed, i.e., the rotation speed of the sanding belts in the sanding belt units 12 or 14, and the rotation speed of the abrasive brushes 13*a* can be adjusted, as can the vertical position above the conveyor belt 11. This way, the machining gap through which the sheet metal part to be machined is transported can be adjusted. The machining gap is also referred to as the infeed and defines the distance between the upper side of the conveyor belt 11 and the upper side of the machining tool.

Both the sanding belts 12*a*, 14*a* and the abrasive brushes 13*a* can be exchanged by means of a quick-change device. The sanding belt 14*a* can be exchanged for a sanding belt with a different grit, or the abrasive brushes 13*a* can be exchanged for other abrasive brushes, for example, with smaller and more flexible abrasive lamellae.

The technical data of the machining tools used and of other applicable machining tools is stored in a tool memory 15.

Figure 3:
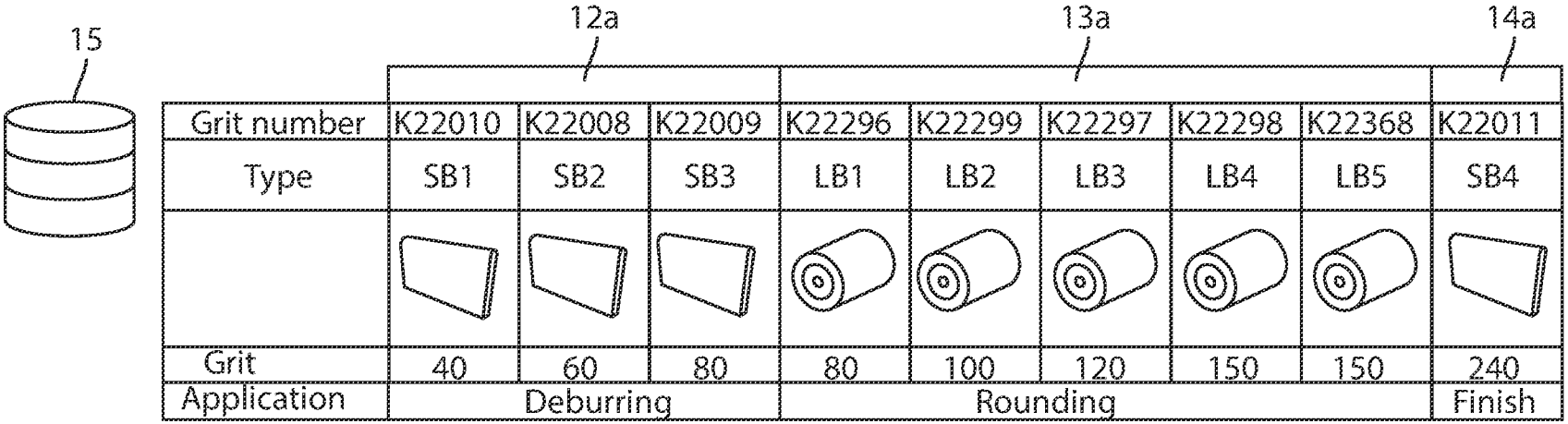
FIG. 3 shows a selection of machining tools for the machine of FIG. 1.

FIG. 3 shows, by way of example, the content of the tool memory 15, namely the identification number, type and grit of three different sanding belts 12*a*, four different sanding belts 13*a* and a further sanding belt 14*a* for the second sanding belt unit 14. Furthermore, the application for which the respective machining tool is intended is indicated, for example, deburring, rounding or fine grinding (finish).

The possibility to use different machining tools in the three machining stations and to adjust the vertical position or the infeed as well as the machining speed in each case leads to a high adaptation variability of the machine to different applications. In addition, there is the variable transport speed of the conveyor belt 11.

The machine 10 has a device 20 for providing a suggestion for an optimal adjustment and an operator terminal 30 with a touch screen 31 with which the user can make inputs and/or receive information from or about the machine.

Figure 2:
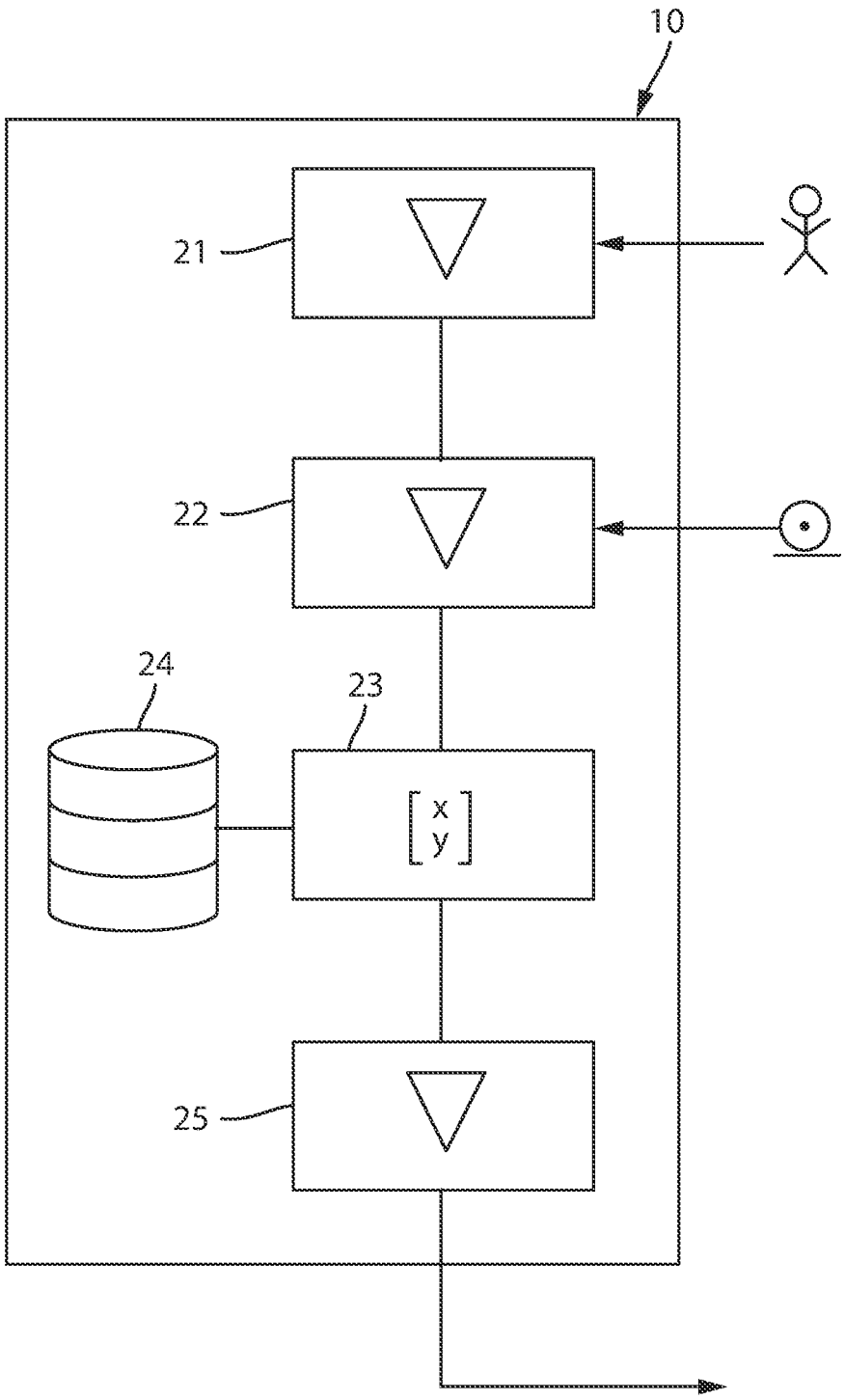
FIG. 2 is an illustration of a device for providing a suggestion for the optimal adjustment of the machine of FIG. 1.

Referring to FIG. 2, the device 20 comprises a first input interface 21 for receiving workpiece data containing information about the sheet metal part to be machined and for receiving machining data containing information about the desired machining result. This information must be entered by the user. A graphical user interface with input and dialog windows displayed on the touch screen 31 is used for this purpose.

The device 20 further comprises a second input interface 22 for receiving machine data with information about the machining stations, in the present case about the first sanding belt unit 12, the brush unit 13 and the second sanding belt unit 14 including information about the machining tools used or usable in this regard. This machine data is not entered by the user but is stored in the machine.

An evaluation unit 23 determines a suggestion for the adjustment of the machine based on the workpiece data and machining data entered by the user as well as the machine data. Possible, sensible as well as optimal adjustment suggestions are contained in a logic memory 24 which can be accessed by the evaluation unit 23.

An output interface 25 is used to transmit the suggested adjustment, which is displayed to the user on the touch screen 31. The user can accept this suggested adjustment, whereupon the suggested adjustments are transferred to the control unit of the machine 10, and the machining stations are adjusted accordingly. If the machining suggestion contains a machining tool that is not currently used in the machine but would, in principle, be available, the touch screen 31 prompts the user to change the tool.

The device 20 is self-learning. If new combinations of machining tools and adjustments are generated due to the interaction with the user, these can be added to the suggested adjustments already stored in the memory 24.

At the start of the adjustment procedure, the user can initiate an automatic wear measurement of individual or all machining tools by means of the touch screen 31. The results of these wear measurements are then automatically taken into account when the machining suggestions are generated. The diameter of the abrasive brushes 13*a* may have decreased due to wear, which would result in a machining gap that is too large. If the current diameter of the abrasive brushes is determined before the adjustment suggestion is generated, the changed diameter can be taken into account and the wear compensated for in this way.

Figure 4:
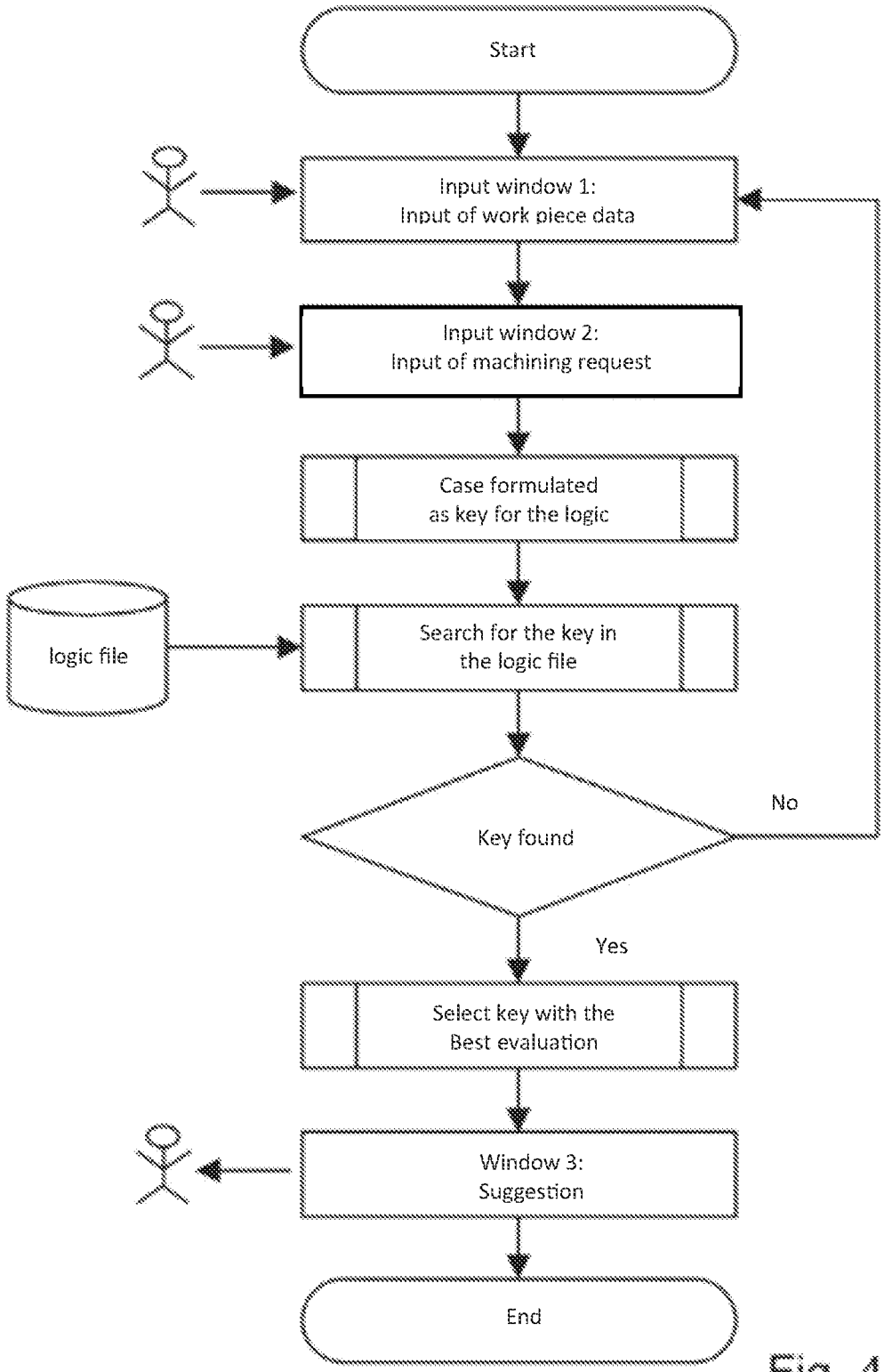
FIG. 4 illustrates a method for providing a suggestion for the optimal adjustment of the machine of FIG. 1.

According to FIG. 4, the method for providing a suggestion for the optimal adjustment of the sheet metal working machine can formulate a key from the workpiece data entered by the user and the machining request. The evaluation unit (23 in FIG. 2) can then search for a corresponding key in a logic file. If no key is found, negative feedback is sent to the user. If a suitable key is found, a suggestion is made for the adjustment of the machine in accordance with this key. If several suitable keys are found, they are evaluated, in particular with regard to the quality of the machining result but also with regard to the highest possible machining speed. The key deemed to be the best key is selected and used as the basis for the adjustment suggestion.

REFERENCE NUMERALS

10 Machine
11 Transport belt
12 Sanding belt unit
12*a* Sanding belt
13 Brush unit
13*a* Abrasive brushes
14 Sanding belt unit
14*a* Sanding belt
15 Tool memory
20 Device
21 First input interface
22 Second input interface
23 Evaluation unit
24 Logic memory
25 Output interface
30 Operator terminal
31 Touch screen

The invention claimed is:

1. A computer for providing a suggestion for adjustment of a sheet metal working machine having a plurality of machining stations with machining tools arranged along a conveyor belt, the computer being configured to:

receive, from an operator, workpiece data with information about a sheet metal part to be machined and machining data with information about the desired machining result;

receive machine data with information about the machining stations;

determine an adjustment suggestion for an adjustment of the machine based on the received workpiece data, machining data, and machine data;

transmit the adjustment suggestion to a control unit of the machine to control the adjustment of the machining stations according to the adjustment suggestion;

store a plurality of keys associated with previous machining cases;

formulate a setting key based on the received workpiece data and machining data;

compare the setting key with the plurality of keys to identify one or more matching keys;

when one or more matching keys are identified, perform a comparison of the one or more matching keys with one another based on respective quality of machining results and machining speeds associated with the one or more matching keys;

select a selected key from the one or more matching keys based on the comparison; and use the selected key as the basis for determining the suggestion for the adjustment of the machine.

2. The computer according to claim 1, wherein the computer is further configured to receive information about the material, the strength, the outer shape, the size, the weight, the surface finish, and/or the location and shape of the inside and/or outside edges of the sheet metal part to be machined.

3. The computer according to claim 1, wherein the computer is configured to receive information about the surface quality to be achieved and/or the curvature radius of the edges of the sheet metal part to be machined and/or the transport speed of the conveyor belt.

4. The computer according to claim 1, wherein the computer is configured to receive information about the type, condition, availability, load capacity and/or degree of wear of the machining tools in the machining stations.

5. The computer according to claim 1, wherein the adjustment suggestion comprises information about the selection of the machining tools to be used, the adjustments of the machining tools and/or the transport speed of the transport belt.

6. A machine for machining a sheet metal part, comprising:

a conveyor belt for transporting the sheet metal part to be machined;

a plurality of machining stations with machining tools which are arranged along the conveyor belt in order for the sheet metal part to pass through one after the next; and a computer according to claim 1.

7. The machine according to claim 6, wherein the machining stations comprise various machining tools for deburring, grinding the surface and/or rounding the edges of the sheet metal part.

8. The machine according to claim 6, wherein the machining stations comprise a quick-change device for the machining tools.

9. A computer implemented method for providing a suggestion for adjustment of a sheet metal working machine having a plurality of machining stations with machining tools arranged along a conveyor belt, the method comprising the steps of:

receiving, from an operator, workpiece data with information about the sheet metal part to be machined and machining data with information about the desired machining result;

receiving machine data with information about the machining stations;

determining an adjustment suggestion for an adjustment of the machine based on the workpiece data, machine data, and machining data received;

transmitting the adjustment suggestion to a control unit of the machine to control the adjustment of the machining stations according to the adjustment suggestion;

storing a plurality of keys associated with previous machining cases;

formulating a setting key based on the received workpiece data and machining data;

comparing the setting key with the plurality of keys to identify multiple matching keys;

performing a comparison of the multiple matching keys with one another based on respective quality of machining results and machining speeds associated with the multiple matching keys;

select a selected key from the multiple matching keys based on the comparison; and use the selected key as the basis for determining the suggestion for the adjustment of the machine.

10. The method according to claim 9, wherein the workpiece data comprises information about the material, strength, external shape, size, weight, surface finish, and/or edge formation of the sheet metal part to be machined.

11. The method according to claim 9, wherein the machining data comprises information about the surface quality to be achieved and/or the radius of curvature of the sheet metal part to be machined.

12. The method according to claim 9, wherein the machine data comprises information about the type, condition, availability, load capacity and/or degree of wear of the machining tools in the machining stations.

13. A non-transitory computer-readable medium comprising a computer program product, that when executed on a computer performs the steps of claim 9.

* * * * *